US007775863B2

(12) United States Patent
Sato et al.

(10) Patent No.: US 7,775,863 B2
(45) Date of Patent: Aug. 17, 2010

(54) COIN DISPENDING DEVICE AND METHOD FOR RAPIDLY RECYCLING COINS

(75) Inventors: Yutaka Sato, Iwatsuki (JP); Shigeo Kawauchi, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 935 days.

(21) Appl. No.: 11/413,719

(22) Filed: Apr. 28, 2006

(65) Prior Publication Data

US 2006/0260905 A1 Nov. 23, 2006

(30) Foreign Application Priority Data

Apr. 28, 2005 (JP) ..... 2005-133478

(51) Int. Cl.
*G07D 1/06* (2006.01)

(52) U.S. Cl. ..... 453/33; 453/49; 453/57; 194/302

(58) Field of Classification Search ..... 453/6, 453/10, 12, 13, 33–35, 49, 57
See application file for complete search history.

(56) References Cited

U.S. PATENT DOCUMENTS 3,757,916 A * 9/1973 Selby ..... 194/227
4,398,550 A * 8/1983 Shireman ..... 453/32
4,441,515 A * 4/1984 Goepner ..... 453/32
5,462,480 A * 10/1995 Suzukawa ..... 453/49
5,865,673 A * 2/1999 Geib et al. ..... 453/10
6,039,166 A * 3/2000 Abe et al. ..... 194/317
6,200,213 B1 * 3/2001 Cole ..... 453/30
6,609,966 B1 * 8/2003 Kurosawa et al. ..... 453/57
6,626,751 B1 * 9/2003 Umeda ..... 453/57
6,776,703 B2 * 8/2004 Abe et al. ..... 453/57
7,059,957 B2 * 6/2006 Kurosawa et al. ..... 453/57
7,186,176 B2 * 3/2007 Umeda ..... 453/29
2005/0009464 A1 * 1/2005 Nireki et al. ..... 453/57

FOREIGN PATENT DOCUMENTS

JP 08-110960 4/1996
JP 09-180020 7/1997
JP 2000-076507 3/2000
JP 2004-070660 3/2004

* cited by examiner

*Primary Examiner*—Jeffrey A Shapiro

(57) ABSTRACT

A method and device for dispensing coins from a compact coin dispensing device while fully utilizing the storage capacity of a retaining bowl. The coin dispensing device or devices can be installed in a coin recycling machine where coins are retained by specific denominations. Detectors monitor the coins that are dispensed and the coins that are accepted into the retainer bowls and a control unit can appropriately coordinate and automatically drive a motor in a reverse direction for a predetermined movement and/or predetermined time after a coin dispensing operation and/or a coin depositing operation into a retainer bowl to prevent coin stacking and to maximize the storage capacity.

9 Claims, 8 Drawing Sheets

COIN DISPENDING DEVICE AND METHOD FOR RAPIDLY RECYCLING COINS

BACKGROUND OF THE INVENTION

1. Field of the Invention

The present invention relates to a coin dispensing device, dispensing method and coin recycling device capable of rapidly dispensing coins even when only a small number of coins are stored.

2. Description of Related Art

The term "coin" used herein embraces coins of currency, tokens, medals and the like, which may be circular and polygonal in shape. There is known a coin dispensing device for separating and dispensing coins one by one by a rotary disc, wherein a rod-like elastic member is arranged so as to completely dispense the coins (see Japanese patent document JP-2004-70660A).

Japanese patent document JP-9-180020 discloses in FIGS. 2-10 a dispensing device for separating and dispensing coins one by one by a rotary disc, wherein coins are flipped by momentum by a coin runner and caused to stack dispersively in a hopper with this momentum in order to prevent the dropping coins from angularly stacking in the coin retaining hopper and thereby reducing the number of retained coins.

FIGS. 1-4 of Japanese patent document JP-8-110960 disclose a coin dispensing device for separating and dispensing coins by a feeding circular disc, wherein when a specified number of coins are received, the feeding circular disc is reversely rotated for stirring and thereby flattening the retained coins, in order to prevent any dropping coins from angularly stacking in the coin retaining hopper and thereby reducing the possible retained number of coins.

There is also known a technique wherein a rotary disc for dispensing coins is driven by a inner-rotor brushless DC motor, and stopped by application of an electric brake (Japanese patent document JP 2000-76507).

SUMMARY OF THE INVENTION

In the conventional art, if a rotary disc is aslant, a coin can be latched by the rotary disc in a lowermost position. For this reason, a distal end of a rod-like elastic member should be located in that lowermost position. In such a case, since the rod-like elastic member is deformed by the rotary disc into a narrower space from a wider space, it cannot fully recover its original form once it is deformed. Furthermore, since this rod-like elastic member is caused to be returned by utilizing its own elasticity, it should be longer than a certain design length. Therefore, a rod-like elastic member is difficult to be applied in a small coin dispensing device in which a rotary disc is arranged aslant.

When a coin runner is used, it is generally not suitable for miniaturization of the coin dispensing device and can not be readily employed due to a rise in cost.

If angularly stacked coins are flattened by reversely rotating a rotary disc, there is no need to provide an additional device.

However, when the remaining number of coins in storage is small (for example only one or two coins), the rotary disc does not always receive a coin quickly in a receiver hole, for example, due to the coins jumping up randomly by rotation of the rotary disc. In such a case, there arises a problem in that a specified number of coins cannot be dispensed quickly.

When the rotary disc is rotated reversely for quickly receiving coins in the receiver, the coins remain located in the receiver of the rotary disc without dispensing the same.

However, since a stacking number of coins can trigger reverse rotation, a too small number of remaining coins cannot trigger the reverse rotation of the rotary disc as described above.

Thus, a first object of the present invention is to provide a coin dispensing method and device capable of quickly dispensing a coin when the remaining amount of coins in a retaining bowl is small.

A second object of the present invention is to provide a coin dispensing method and device capable of effectively using a full retaining capacity of a coin retaining bowl.

A third object of the present invention is to provide a coin recycling machine capable of quickly dispensing a specified number of specified coins.

In order to achieve these objects, the present invention can be carried out as follows.

A coin dispensing method for a coin dispensing device, comprising: separating and dispensing coins one by one by rotation of a rotary disc in a forward direction; and stopping the rotary disc after dispensing a specified number of coins. The method further comprising rotating the rotary disc in a direction opposite to the forward direction by a predetermined amount after the rotary disc stops.

In such a configuration, the rotary disc can rotate in a forward direction and dispense coins one by one. When a specified number of coins are dispensed, the rotary disc is stopped, and immediately after completion of the dispensing of the desired number of coins, the rotary disc is rotated by a predetermined amount in a reverse direction.

When the rotary disc is reversely rotated, the coins are stirred by the receiver or the like of the rotary disc, but not dispensed. When the coins are stirred, the coins are changed into various positions, so that they are more likely to be received by the receiver of the rotary disc. The reverse rotation of the rotary disc is conducted whenever the dispensing of coins is completed. Therefore, the coins are more likely to be positioned in the receiver by the reverse rotation after completion of a coin dispense operation, which is advantageous in that coins can be quickly dispensed in the next dispensing cycle.

Further, since the deposited coins may become angularly stacked, the coins will be stirred by the reverse rotation after a coin dispense operation and any stacked coins will be flattened. This is advantageous in that the coins can be retained with a best use of the retaining capacity of the retaining bowl.

A coin dispensing method may be carried out in a coin dispensing device, comprising: separating and dispensing coins one by one by a forward rotation of a rotary disc provided in a bottom part of a retaining bowl by rotating the rotary disc in a forward direction and stopping the rotary disc after dispensing a specified number of coins. The method further comprising after a stop of the rotary disc, rotating the rotary disc in a direction opposite to the forward direction by a predetermined amount, and when the coins input into the retaining bowl reach a specified number, there is an automatic rotation of the rotary disc in a reverse direction by a predetermined amount.

In this configuration, when the number of newly received coins in the retaining bowl reaches a specified number, the rotary disc is reversely rotated by a predetermined amount of turns whereby the retained coins are stirred and any angularly stacked coins are leveled and rendered uniformed.

Accordingly, also in this case, the coins can be retained with a best use of the retaining capacity of the retaining bowl for retaining coins.

A coin dispensing device is provided in which coins are separated and dispensed one by one by a forward rotation of a rotary disc by a motor in a forward direction. The rotary disc is stopped after dispensing of a specified number of coins. The coin dispensing device comprising, a reverse rotation unit that rotates the motor in a reverse direction to cause the rotary disc to rotate in a direction opposite to the forward direction by a predetermined amount after a stopping of the rotary disc.

In this configuration, the rotary disc rotates in the forward direction and dispenses coins one by one. When a specified number of coins are dispensed, the rotary disc is stopped to end the dispension of coins. Immediately after stopping of the rotary disc, the rotary disc is reversely rotated by a predetermined amount by a reverse rotation unit. When the rotary disc is reversely rotated, the coins are stirred by the receiver or the like of the rotary disc, but no coins are dispensed. When the coins are stirred, the coins are changed into various positions, so that they are more likely to be delivered to the receiver of the rotary disc.

The reverse rotation of the rotary disc is conducted whenever a dispension of coins is completed. Therefore, coins are more likely to be positioned in the receiver by a reverse rotation after completion of a coin dispensing operation, which is advantageous in that coins can be quickly dispensed in the next dispense cycle. Further, when the coins are angularly stacked, the coins will be stirred by the reverse rotation after a coin dispense, and the stacked coins are flattened.

In a coin dispensing device, where coins are separated and dispensed one by one by a forward rotation of a rotary disc disposed in a bottom part of a retaining bowl by a motor and the rotary disc is stopped after dispensing of a specified number of coins, the coin dispensing device comprising, a reverse rotation unit that rotates the motor in a reverse direction to cause the rotary disc to rotate in a direction opposite to the forward direction by a predetermined amount after stopping of the rotary disc, and an accepted money reversing unit that rotates the motor in the reverse direction by a predetermined amount when a detection signal from a money acceptance detector detects that the coins accepted in the retaining bowl reach a specified number.

When the number of newly received coins in the retaining bowl reaches a specified number, the rotary disc is automatically reversely rotated by a predetermined amount by the accepted money reversing unit. When the rotary disc is reversely rotated by a predetermined amount, the retained coins are stirred and any angularly stacked coins are leveled and rendered uniform. Accordingly, the coins can be retained with a best use of the retaining capacity of the retaining bowl for retaining coins.

The motor can be a brushless DC motor. In this configuration, when an electric brake is employed as a stop unit, a rotary force in a direction opposite to the dispensing direction is applied to cause a sudden stop for preventing the next coin from being dispensed. When the power supply is blocked after that sudden stop, the rotor continues to rotate reversely by the inertial force, and then completely stops. This inertial reverse rotation achieves reverse rotation after the stop, so that an advantage of energy reduction is realized. Furthermore, since a special braking device is not required, it is possible to miniaturize the device and to reduce the costs.

A coin recycling machine wherein coins are retained by denomination in a coin dispensing device and a specified number of a specified denomination of coins are dispensed according to a coin dispense instruction, includes a coin dispensing device for separating coins inputted to a coin receiver by specified denominations in the course of conveyance on a predetermined path, retaining the coins in bulk and dispensing coins one by one. The coin recycling machine including a coin dispensing device having a reverse rotation unit that reversely rotates the rotary disc by a predetermined amount after separating and dispensing a specified number of coins one by one by the rotary disc. Money acceptance detectors are used to detect money acceptance into the coin dispensing device. Money dispense detectors also detect money dispensed from the coin dispensing device. A stacking amount detector unit for calculating a coin retaining amount based on at least a signal of the money acceptance detector is provided and a controller for actuating the reverse rotation unit when the accepted money number based on the money acceptance detector reaches a specified number.

In this configuration, the coins input into the coin dispensing device are separated by denomination during conveyance on a predetermined path, and retained in coin dispensing devices of individual denominations. At the time of retaining the coins, the coins are detected by the money acceptance detector. On the other hand, the coin dispensing device dispenses, based on a money dispense instruction, a specified number of coins one by one by forward rotation of the rotary disc.

The money dispense detector detects a coin whenever the coin is dispensed, and sends a detection signal to a stacking amount detector unit. When a specified number of coins are dispensed, the rotary disc is stopped by a stop unit to end the coin dispense cycle. After stopping, the rotary disc is reversely rotated by a predetermined amount by a reverse rotation unit. When the rotary disc is reversely rotated, the coins are stirred by the receiver or the like of the rotary disc, but no coins are dispensed. When the coins are stirred, the coins are changed into various positions, so that they are more likely to be received into the receiver of the rotary disc.

A reverse rotation of the rotary disc is conducted whenever a dispensing of coins is completed. Therefore, the coins are more likely to be positioned in the receiver by the reverse rotation after completion of a coin dispense cycle, which is advantageous in that coins can be quickly dispensed in the next coin dispensing. Further, when the coins are angularly stacked, the coins will be stirred by the reverse rotation after a coin dispense, and the stacked coins are leveled.

Furthermore, the stacking amount detector sends a reverse rotation signal to the reverse rotation unit of the coin dispensing device at least when the accepted number of coins from the money acceptance detector reaches a specified number, and automatically reversely rotates the rotary disc by a predetermined amount. As a result, the coins are stirred and any angularly stacked coins that are newly input are leveled and flattened. In this manner, the coins that are newly input and are angularly stacking are leveled, so that it is possible to retain the coins with the best use of the retaining capacity of the coin retaining bowl.

In the coin recycling machine, the controller determines an amount of reverse rotation of the rotary disc based on an amount of coins in the coin dispensing device and an accepted money number.

In this configuration, since the amount of any reverse rotation of the rotary disc may be appropriately selected depending on the coin size and the capacity of the retaining bowl, an advantage arises in that the full capacity of the retaining bowl may be used with the least energy consumption.

A coin dispensing method carried out in a coin dispensing device, comprising: separating and dispensing coins one by one by rotation of a rotary disc by rotating a rotary disc in a forward direction; and stopping the rotary disc by stop units after dispensing a specified number of coins, the method further comprising: rotating the rotary disc in a direction opposite to the forward direction by a predetermined amount after the rotary disc stops.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
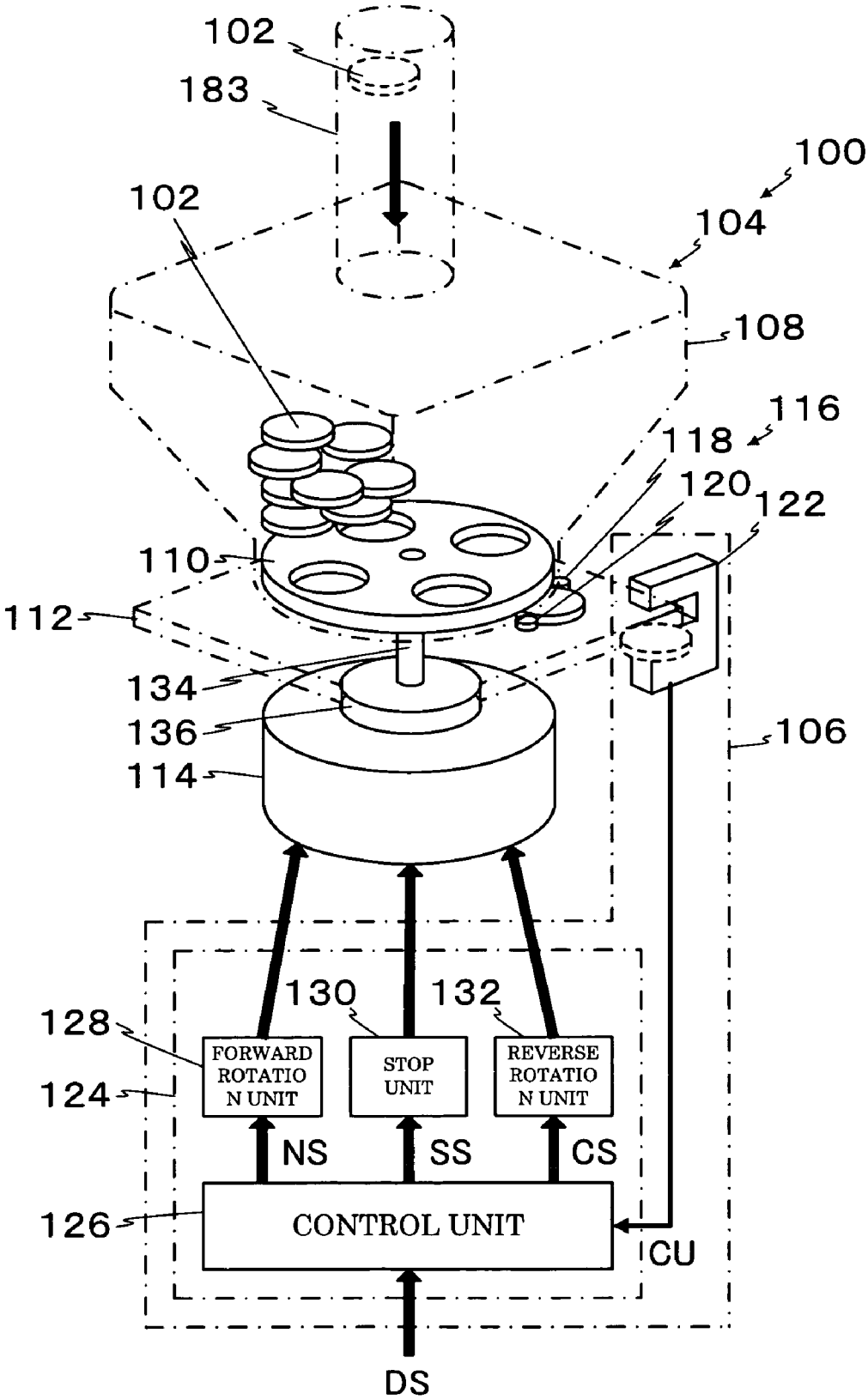
FIG. 1 is a schematic view of a coin dispensing device for carrying out a coin dispensing method of a first embodiment of the present invention.
Figure 2:
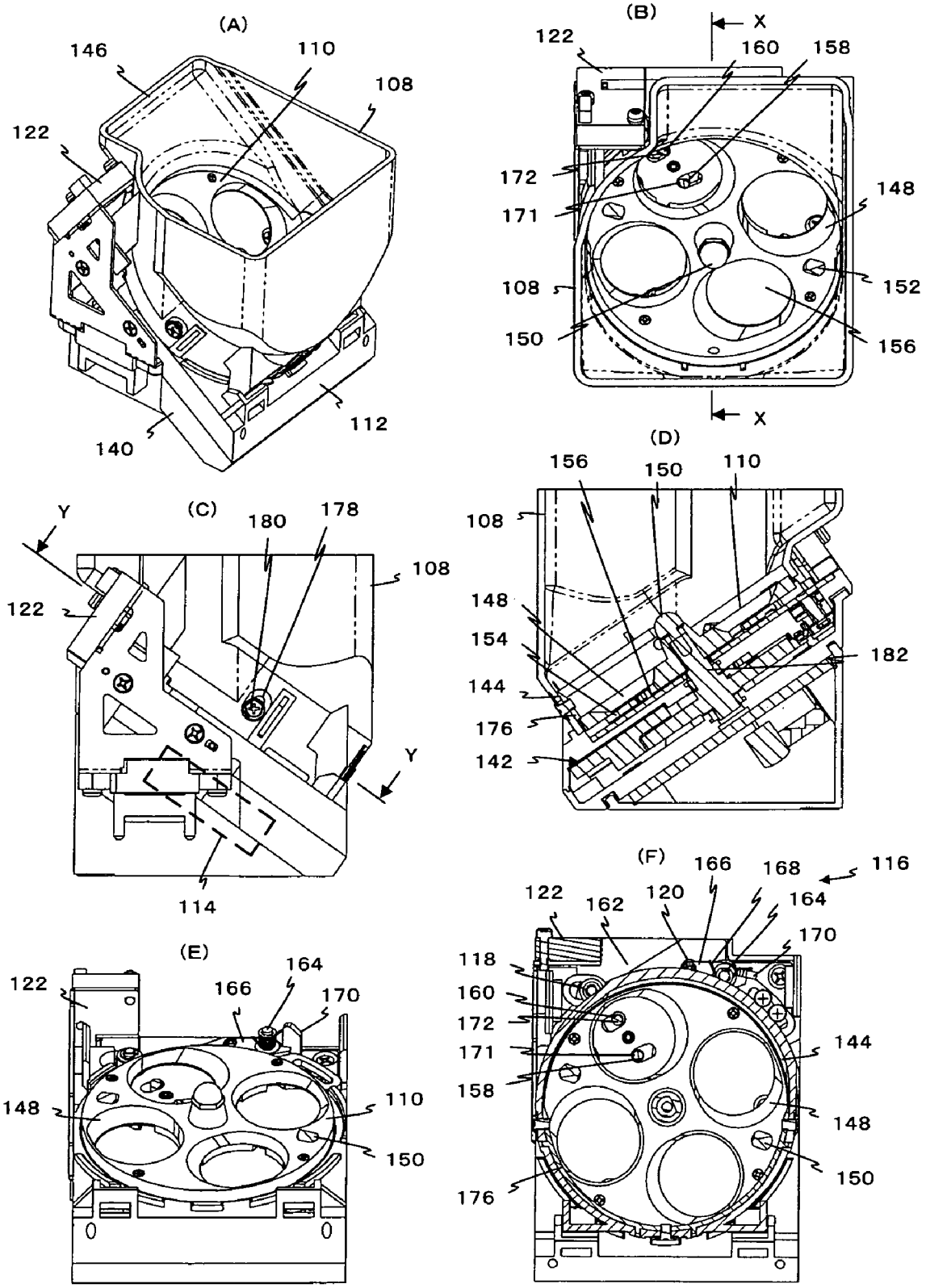
FIGS. 2A to 2F are a perspective view, a plan view, a left side view, a section view along the line X-X in FIG. 2B, a front view in which a retaining bowl is removed, and a section view along the line Y-Y of FIG. 2C of a coin dispensing device suited for carrying out the coin dispensing method of the first embodiment of the present invention.
Figure 3:
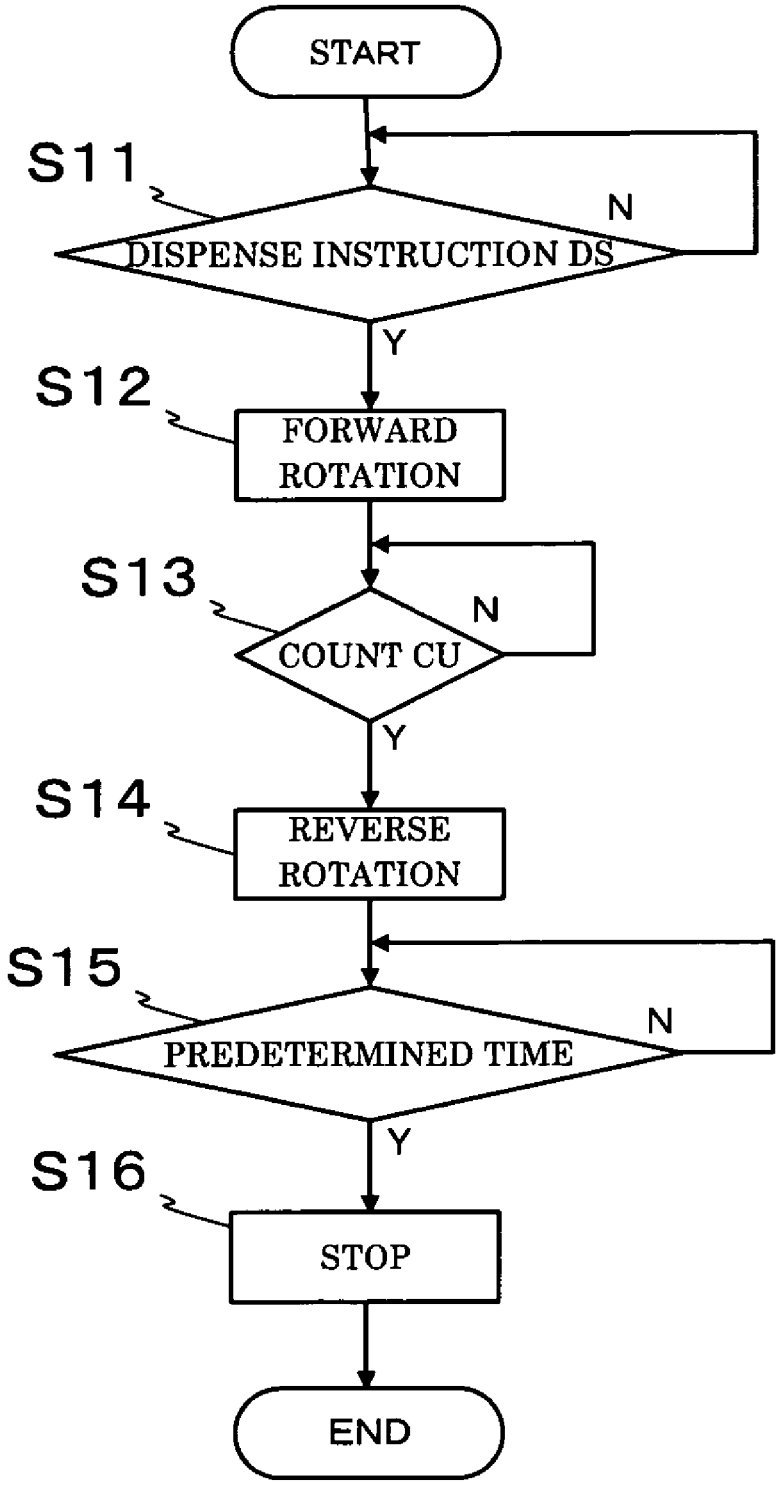
FIG. 3 is a flowchart of a coin dispensing method of the first embodiment of the present invention.

A first embodiment will be explained with reference to FIGS. 1 to 3. A coin dispensing device 100 separates and dispenses retained coins 102 one by one, and includes a hopper 104 and a controller 106. The hopper 104 includes a tubular shaped retaining bowl 108 for retaining coins 102, a rotary disc 110 disposed in the bottom of the retaining bowl 108 for separating coins 102 one by one, a base 112 of a flat plate on which coins 102 slide while accompanying the rotary disc 110, a motor 114 for rotationally driving the rotary disc 110, and a dispenser 116 for flipping out a coin 102.

The dispenser 116 includes a stationary roller 118 disposed such that its one side is in a stationary state with respect to the base 112, and a movable roller 120 disposed to be movable with respect to the base 112 and biased to approach the stationary roller 118. A coin 102 will be swiftly flipped by a biasing force of the movable roller 120 after its diametrical extent has passed through the rollers.

The motor 114 may be implemented by, an electric motor, air motor, oil motor and the like, however, an electric motor is the most preferable because of the easiness of control. Such electric motor may be energized by a DC power supply or an AC power supply, and may employ various motor systems such as an induction motor, however, from the view points of miniaturization, maintenance and durability, a brushless DC motor is preferred.

The controller system 106 includes a money dispense detector 122 for detecting a coin 102 dispensed one by one by rotation of the rotary disc 106, and a control unit 124 that selectively control the motor 114 to forwardly rotate, reversely rotate, or stop in response to an externally given instruction for coin dispension or a detection signal CU from the money dispense detector 122. The control unit 124 includes a main control unit 126, a forward rotation unit 128, a stop unit 130 and a reverse rotation unit 132 and can include a microprocessor microcontroller with appropriate I/O interfaces and a stored operating control program.

The money dispense detector 122 detects a coin 102 dispensed by the dispenser 116, and outputs a detection signal CU to the control unit 124. The money dispense detector 122 may be a contact system that detects a coin 102 in a contacting manner, or a non-contact system that detects a coin 102 in a non-contacting manner, e.g., optical, electric field, etc. however, a non-contact system is preferably used from the view point of durability and maintenance.

The main control unit 126 receives a dispense instruction from an external device and a detection signal CU from the money dispense detector 122, executes a predetermine processing, and outputs respective operation signals at predetermined timings to the forward rotation unit 128, the stop unit 130 and the reverse rotation unit 132. Therefore, the main control unit 126 may be implemented by a logic circuit or a microprocessor, however, from the view point of miniaturization and easiness of modification, a microprocessor system that executes a predetermined processing based on a program stored in a ROM is preferably used.

Upon reception of a forward rotation signal NS from the main control unit 126, the forward rotation unit 128 forwardly rotates the motor 114. In the first embodiment, the forward rotation is a rotation in the counterclockwise direction in FIGS. 1 and 2. An output axis 134 of the motor 114 forwardly rotates the rotary disc 110 via a speed reducer unit 136 (FIG. 2). Upon reception of a stop signal SS from the control unit 124, the stop unit 130 stops the motor 114.

The term "stop" used herein refers to applying an electric brake to the motor 114 by blocking or shorting the power supply, and stopping rotation of the output axis 134 of the motor 114 by making a braking unit (not shown) to have an effect on the rotary disc 110 while blocking the power supply of the motor 114, and the stop unit 130 stops the rotary disc 110 either directly or indirectly.

Upon reception of a reverse rotation signal CS from the control unit 124, the reverse rotation unit 132 rotates the motor 114 in a direction opposite to that of the forward rotation to make the rotary disc 110 reversely rotate. Therefore, causing the motor 114 to generate a reverse rotary force by the reverse rotation unit 132 during forward rotation of the motor 114 also serves as the brake as described above. In other words, the reverse rotation unit 132 can also serve as the stop unit 130.

Next, a preferred embodiment of the coin dispensing device 100 will be explained with reference to FIG. 2. The same functional parts as those shown in FIG. 1 are denoted by the same numerals, and explanation will be made only for a different configuration. The base 112 is fixed to a frame 140, and inclined at an angle ranging from about 30 degrees to 40 degrees. The retaining bowl 108 is detachably attached to the base 112.

The rotary disc 110 is rotatably attached to a circular hole on the bottom of the retaining bowl 108. The dispenser 116 is disposed right beside the rotary disc 110. The money dispense detector 122 is fixed to the base 112 beside the dispenser 116. The motor 114 is placed in an interior space of the frame 140. The base 112 has a box like shape and accommodates a reducing mechanism 142 or the like in the interior space.

The base 112 is fixed to a slope part of the frame 140 which is a right triangle when viewed laterally, and is inclined at about 30 degrees. The smaller the angle of inclination, the more preferable because the coin retaining capacity of the retaining bowl 108 increases. However, the minimum angle of inclination is about 30 degrees because influence of diameter of the rotary disc 110 on the hopper 104 increases at smaller angles, and the maximum angle of inclination is about 60 degrees because efficiency of coin dispension is deteriorated at larger angles.

To a top face of the base 112, the retaining bowl 108 of a cylinder form is detachably fixed. The retaining bowl 108 has a circular hole 144 in its lower part, and an upper opening 146 formed into a general rectangular shape for increasing the coin retaining capacity. The rotary disc 110 has a plurality of through-holes 148 arranged at predetermined intervals, a stirrer 150 of conical shape in the center of the top face, a chevron stirring projection 152 disposed near the periphery, and a coin pusher 154 on its bottom face.

A coin dropping into the through-hole 148 is held by a top face 156 of the base 112, and in a forward condition, rotated in a counterclockwise direction together with the rotary disc 110 by the pusher 154 of the rotary disc 110 while the periphery thereof is guided by the circular hole 144. Since this coin is prevented from moving by pins 158, 160 projecting in predetermined positions on the top face of the base 112, it is pushed out in the circumferential direction of the rotary disc 110.

Since the circular hole 144 is notched, and a dispensing opening 162 is provided in this position, the pushed out coin 102 is allowed to move outside the retaining bowl 108. In this dispensing opening 162, the dispenser 116 may consist of a stationary roller 118 and a movable roller 120.

In the dispenser 116, the movable roller 120 is rotatably attached to a tip end of a lever 166 that is pivotably attached to a stationary axis 164, and the lever 166 is biased by a string wound spring 168 so as to approach the rotary disc 110. The lever 166 is latched by a stopper 170 in a position where the movable roller 120 is adjacent to the rotary disc 110, and held in a standby position.

The distance between the stationary roller 118 and the movable roller 120, when the stationary roller 118 and the movable roller 120 are in standby position, is set to be smaller than a diameter of the coin 102. Therefore, the coin 102, pushed by the pusher 154, is guided at its one side by the stationary roller 118, so that the movable roller 120 is caused to move in the clockwise direction in FIG. 2. Then immediately after the diametrical extent of the coin 102 has passed between the stationary roller 118 and the movable roller 120, the lever 166 is rapidly rotated in the counterclockwise direction by the spring 168, so that the coin 102 is flipped.

In other words, the coin 102 is flipped along the base 112, and hence it is flipped out diagonally upward. The pins 158, 160 are biased by the spring such that they protrude to the top face 156 from below the base 112, and slopes 171, 172 are formed in an upper end on the opposite side corresponding to the forward rotation of the rotary disc 110.

As a result, when the rotary disc 110 reversely rotates, the slopes 170, 172 are pushed by the coin 102, so that the pins 158, 160 are pressed down against the spring force.

Therefore, the coin 102 overcomes the pins 158, 160, and moves in the clockwise direction together with the rotary disc 110, so that it will not be dispensed through the dispensing opening 162.

In the circular hole 144 on the bottom of the retaining bowl 108, a coin dropper 176 is provided. The coin dropper 176 has an outer face that is in close contact with the peripheral surface of the circular hole 144 and a circumferential edge opposing to the top face of the edge part of the rotary disc 110. As a result, the coin dropper 176 functions to drop the coin 102 rotating integrally with the rotary disc 110 into the through-hole 148.

The coin dropper 176 is formed into a circular arc from a resin plate or metal plate, and fixed at both its ends to the retaining bowl 108 with a screw 180 that penetrates through a slot 178 formed in a lateral wall of the retaining bowl 108. The slot 178 extends in a direction orthogonal to the top face of the rotary disc 110. Therefore, the coin dropper 176 is position-adjustably attached to the lateral wall of the retaining bowl 108 along the axial line of the circular hole 144 such that the distance from the top face of the rotary disc 110, namely the distance from the base 112 falls within the extent of the slot 178.

As a result, a lower end of the coin dropper 176 is situated right above the edge of the rotary disc 110 in the circular hole 144. To be more specific, the distance between the inner face of the coin dropper 176 and an outer lateral edge of the through-hole 148 of the rotary disc 110 is set to be less than half of the thickness of the coin to be retained. It is preferred that the inner surface of the coin dropper 176 overlaps with the peripheral edge of the through-hole 148 when the rotary disc 110 is viewed two-dimensionally.

As a result, when the coin 102 is about to rotate integrally with the rotary disc 110 while riding on the edge of the rotary disc 110, the coin 102 is forced to move toward the through-hole 148 by the coin dropper 176, and the edge of the rotary disc 110 is substantially absent. Consequently, the coin 102 drops in the through-hole 148, making it possible to dispense every last coin 102.

The rotary disc 110 is mounted to an upper end of a rotary shaft 182 rotatably attached to the base 112, so as to be slidable in its axial direction and prevented from rotating with respect to the rotary shaft 182. In other words, by interposing a shim having a low coefficient of friction between the rotary disc 110 and the top face 156 of the base 112, it is possible to adjust the distance therebetween and to make the position of the rotary disc 110 suited for the thickness of the particular coin 102.

In this case, by adjusting the distance between the upper face of the rotary disc 110 and the lower end edge of the coin dropper within the extent of the slot 178, a suitable positional relationship is achieved that will not cause nipping of the coin 102 therebetween and allows quick dropping of the coin 102 into through-hole 148. However, the coin dropper 176 may be integrally molded with the retaining bowl 108.

The positioning device of the rotary disc 110 for a thickness of coin may be implemented by other devices having the same function as the aforementioned shim. Also the positioning mechanism of the coin dropper 176 may be implemented by other devices having the same function.

The money dispense detector 122 is a detector for detecting a coin 102 dispensed by the dispenser 116, and may be implemented by a proximity sensor, an optical detector or the like. However, a proximity sensor that is less susceptible to dust and requires no maintenance is preferably used.

Next, an explanation on a money dispensing process will be given. The motor 114 rotates, and the rotary disc 110 rotates in the counterclockwise direction in FIG. 2 via the reducer 136. This rotation causes the coin 102 dropping into the through-hole 148 to be guided circumferentially of the rotary disc 110 by the pins 158 and 160 and to be flipped by the dispenser 116. At this time, since the coin 102 is guided by the base 112, it is flipped diagonally upward according to the inclination of the base 112. Therefore, the coin 102 is flipped diagonally upward against the gravity, so that the momentum of flipping will be attenuated.

The coin 102 thus flipped is then detected by the money dispense detector 122, and when the detection signal CU reaches a instructed dispense number, an end signal is outputted from the control unit 126 to the forward rotation unit 128 while a stop signal is outputted to the stop unit 130. Thus an electric brake is applied for a certain period of time to the motor 114, and the motor 114 is quickly stopped. In other words, the motor 114 is stopped by a rotary magnetic field in a direction opposite to that of the forward rotation, and following a certain amount of reverse rotation immediately after stopping, power supply is stopped.

Next, an operation of the first embodiment will be explained with reference to a flowchart of FIG. 3. First, at step S11, whether there is a dispense instruction signal DS is determined, and if there is no dispense instruction signal DS, the flow loops step S11. If there is a dispense instruction signal DS, the flow proceeds to step S12 where a forward rotation signal NS is outputted to the forward rotation unit 128. This causes generation of a rotary magnetic field in the forward rotation direction of the motor 114 and thus the rotary disc 110 is rotated in the forward direction.

The coin 102 that has dropped into the through-hole 148, and is pushed by the pusher 154 and sliding on the top face 156 of the base 112 is guided in the circumferential direction by the pins 158, 160 by the forward rotation of the rotary disc 110. As a result, the coin 102 is sandwiched between the stationary roller 118 and the movable roller 120, and flipped by spring force of the spring 168 immediately after the diametrical extent has passed therebetween. The money dispense detector 122 detects the flipped coin 102 and outputs a detection signal CS.

The detection signal CS from the money dispense detector 120 is counted and compared with an instructed dispense number at step S13. When the count is less than the instructed dispense number, the flow loops step S13, whereas when the count reaches the instructed dispense number, the flow proceeds to step S14. At step S14, a reverse rotation signal CS is outputted to the reverse rotation unit 132. The reverse rotation unit 132 causes the motor 114 to generate a rotary magnetic field that rotates in a direction opposite to the forward rotation direction. As a result, the motor 114 suddenly stops under application of braking force, and immediately rotates in the reverse direction.

Therefore, reverse rotation is immediately started after the coins 102 are prevented from being excessively dispensed by the sudden stop of the rotary disc 110. This reverse rotation continues until a predetermined time has elapsed at step S15, and then at step S16, a stop signal SS is outputted to the stop unit 130.

Since the stop unit 130 stops supplying power to the motor 114, the rotary disc 110 naturally stops after reversely rotating for a predetermined time. Due to the reverse rotation of the rotary disc 110, the coins 102 in the retaining bowl 108 will be stirred by the through-hole 148, the stirrer 150 and the stirring projection 152 rather than dispensed through the dispensing opening 62 as described above. Therefore, when the coin 102 drops from a predetermined path 183 and angularly stacks, the angular stack will be leveled and flattened.

The rotary disc 110 will stop after rotating a predetermined angle by inertial force because in the present embodiment, the power supply of the motor 114 to the rotary disc 110 is stopped after a predetermined time of reverse rotation following the stop of the rotary disc 110. Since the rotational resistance of the rotary disc 110 changes with the retained amount of coins 102, the rotational amount of predetermine angle of the rotary disc 110 is variable. Accordingly, the rotation of predetermined amount (angle) after stopping of the rotary disc 110 is preferably set to be more than or equal to a certain amount, for example, set so that the rotary disc 110 rotates by at least 360° and preferably 720°.

Figure 4:
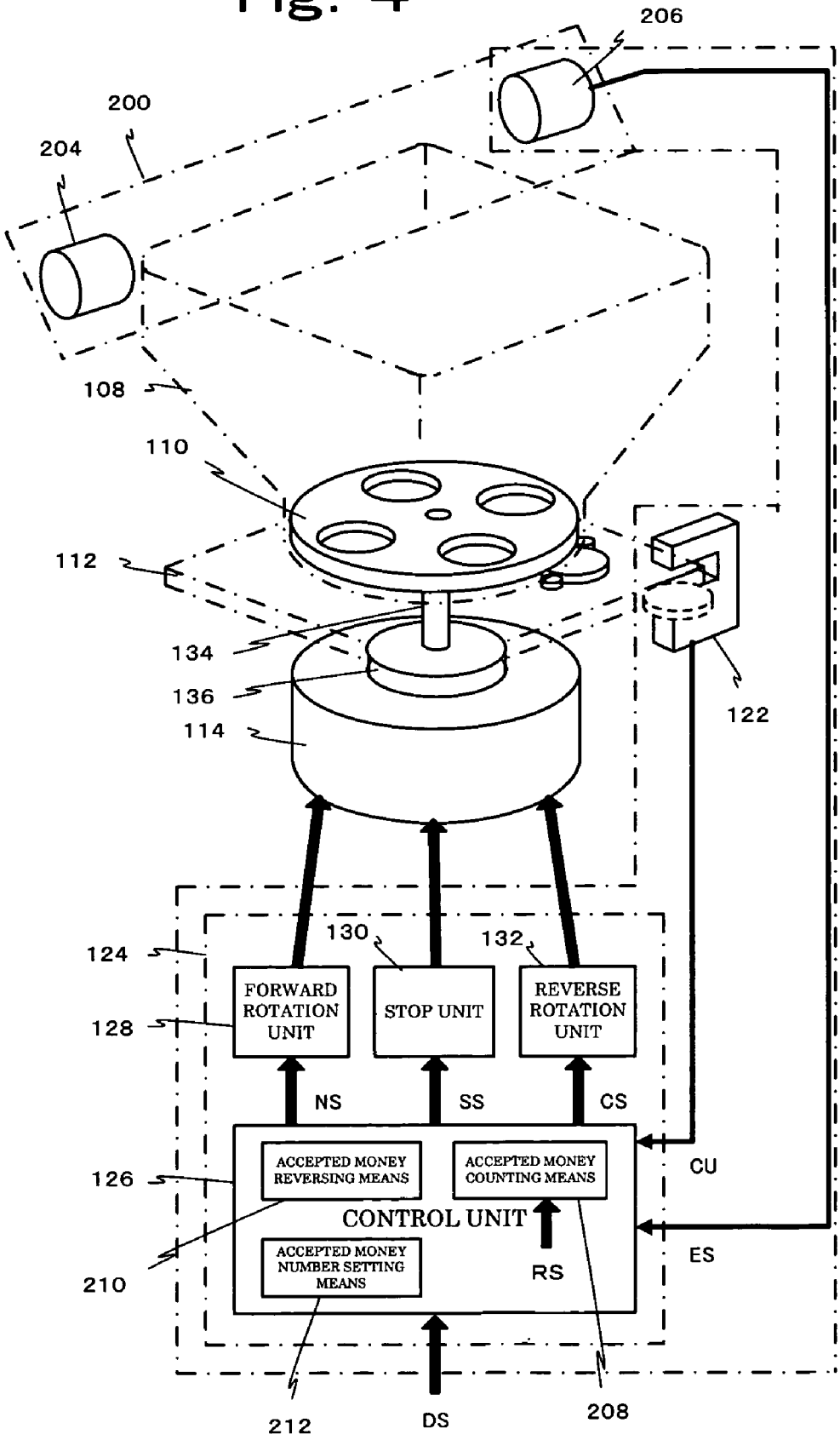
FIG. 4 is a schematic view of a coin dispensing device for carrying out a coin dispensing method of the second embodiment of the present invention.
Figure 5:
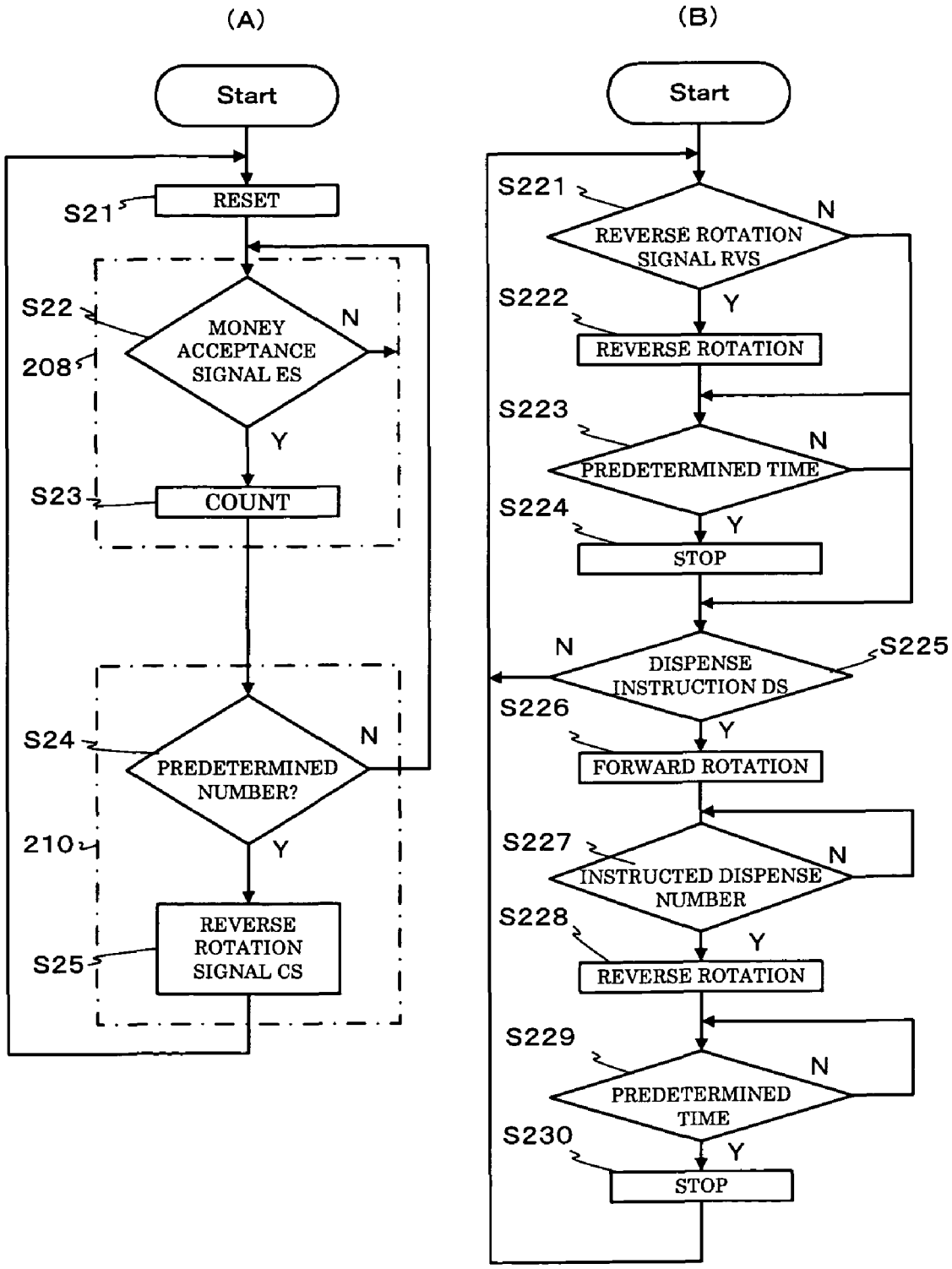
FIG. 5 is a flowchart of a coin dispensing method.

Next, a second embodiment will be explained with reference to FIGS. 4 and 5.

The second embodiment is an example in which a money acceptance detector 200 is added to the first embodiment. That is, by counting the money acceptance signal ES from the money acceptance detector 200, when the coins 102 reach a specified number, or in other words, a specified number of coins 102 are newly put into the retaining bowl 108, the rotary disc 110 is rotated reversely to level and flatten the angularly stacked coins 102.

The coins 102 are input to the retaining bowl 108 one by one through the upper opening 146 from a predetermined position at a certain interval. In order to detect these input coins, an optical transmissive money acceptance detector 200 having a projector 204 disposed on one side of a coin dropping path 202 and a light receiver 206 disposed on the other side is provided. The money acceptance detector 200 may be a reflection optical detector, metal detector or the like. The control unit 124 is equipped with accepted money counting means of unit 208 and accepted money reversing means of unit 210.

The accepted money counting means 208 counts up a counting value whenever it receives a money acceptance signal ESS from the money acceptance detector 200, and resets the counting value to zero upon reception of a reset signal RS issued under a predetermined condition. The accepted money reversing means 210 outputs a reverse rotation signal CS to the reverse rotation unit 132 when the counting value of the accepted money counting means 208 reaches a specified number, for example, 10.

It is also preferred to provide accepted money number setting means 212 for setting a counting value for comparison (comparative value in step S227 described below) in the accepted money counting means 208. In other words, since the stacking amount of coins in the retaining bowl 108 differs according to the size of coin even for the same number of coins, it is necessary to optimally set a reference value for conducting a flattening suited for a particular coin denomination.

As can be appreciated the control unit 126 can implement the accepted money reversing means 210, the accepted money counting means 208 and the accepted money number setting means 212 in software by an appropriate program loaded into the control unit. Alternatively, a hardwire current can be dedicated to these functions.

Next, an operation of the second embodiment will be explained with reference to a flowchart of FIG. 5. First, referring to FIG. 5(A), a money acceptance processing program of money acceptance signal ES from the money acceptance detector 200 will be explained. In the second embodiment, settings are made so that when the counting value of the accepted money counting means 208 reaches 10, a reverse rotation signal CS is outputted to the reverse rotation unit 132.

At step S21, the counting value from the money acceptance detector 200 is reset to zero. Next, at step S22, whether a detection signal ES from the money acceptance detector 200 is present is determined. If there is no money acceptance signal ES, the flow loops step S22, whereas if there is a money acceptance signal ES, the program flow proceeds to step S23.

After counting the money acceptance signal ES at step S23, the program flow proceeds to step S24. At step S24, whether the counting value is 10 or not is determined, and when it is less than 10, the flow returns to step S22, whereas when it is 10, the program flow proceeds to step S25. In other words, when the counting value is 10, it indicates a state that new coins are dropped from one position into the retaining bowl 108 and angularly stack therein. After outputting a reverse rotation signal CS to a control program of the rotary disc 110 as will be later explained at step S25, the program flow proceeds to step S21.

Next, explanation will be given for a money dispense processing program shown in FIG. 5(B). First, at step S221, whether there is a reverse rotation signal RVS of a money acceptance processing program is determined. When there is a reverse rotation signal RVS, the flow proceeds to step 5222 where a reverse rotation signal CS is outputted to the reverse rotation unit 132. As a result, the motor 114 reversely rotates as described above, so that the rotary disc 110 also rotates reversely.

Then after timing for a predetermined time period at step 5223, the flow proceeds to step 5224 where a stop signal SS is outputted to the stop unit 130. As a result, the stop unit 130 stops supplying power to the motor 114, so that the motor 114 or the rotary disc 110 will stop after rotating a predetermined angle by an inertial force. Thus the rotary disc 110 is rotated for a predetermined time (predetermined angle), and the coins 102 stacking as described above are stirred and flattened. This makes it possible to retain the coins 102 while sufficiently utilizing the coin retaining capacity of the coins 102.

Then the flow proceeds to step S225 where whether there is a dispense instruction signal DS is determined. When there is no dispense instruction signal DS, the flow returns to step S221, and loops step 5221 and 5225. When there is a dispense instruction signal DS, the flow proceeds to step 5226 where a forward rotation signal NS is outputted to the forward rotation unit 128. In response to this NS signal, the forward rotation unit 128 causes the motor 114 to generate a rotational magnetic field of the forward rotation as is the case with the first embodiment, so that the output axis 134 of the motor 114 forwardly rotates and hence the rotary disc 110 rotates forwardly.

Immediately after having been guided circumferentially by the pins 158, 160 by the forward rotation of the rotary disc 110, the coin 102 is flipped by the movable roller 120. The flipped coin 102 is detected by the money dispense detector 122, and the detection signal CU is counted and compared with an instructed dispense number at step 5227. When the counted number is less than the instructed dispense number, the flow loops step 5227, and when the counted number reaches the instructed dispense number, the flow proceeds to step 5228.

At step 5228, a reverse rotation signal CS is outputted to the reverse rotation unit 132. As a result, a braking force is exerted on the motor 114 in the same manner as the first embodiment, and the motor 114 reversely rotates following the sudden stop. In other words, the rotary disc 110 reversely rotates immediately after the sudden stop. This reverse rotation is continued until a predetermined time has elapsed at step 5229, and then a stop signal SS is outputted to the stop unit 130 at step S230.

Since the stop unit 130 stops supplying power to the motor 114, the rotary disc 110 rotates by a predetermined angle by inertia forces as is described above, and accordingly will eventually stop as a result of frictional resistance. Since the coins 102 in the retaining bowl 108 are stirred by the through-hole 148, the stirrer 150 and the stirring projection 152, due to this reverse rotation, and the angularly stacked coins, if any, will be leveled and flattened.

In the second embodiment, when the number of coins 102 that are newly input reaches a specified number, the rotary disc 110 reversely rotates by a predetermined angle, and hence angularly stacking coins can be leveled and flattened by the reverse rotation without dispensing any coins 102. This provides an advantage that the retention of coins utilizing the full retaining capacity of the retaining bowl 108 can be achieved. Therefore, steps S22 and S23 of the program correspond to the accepted money counting means 208, and steps S24 and S25 correspond to the accepted money reversing means 210. Although the accepted money counting means 208 and the accepted money reversing means 210 are configured by software in the present embodiment, they may be configured by hardware such as a block circuit.

Figure 6:
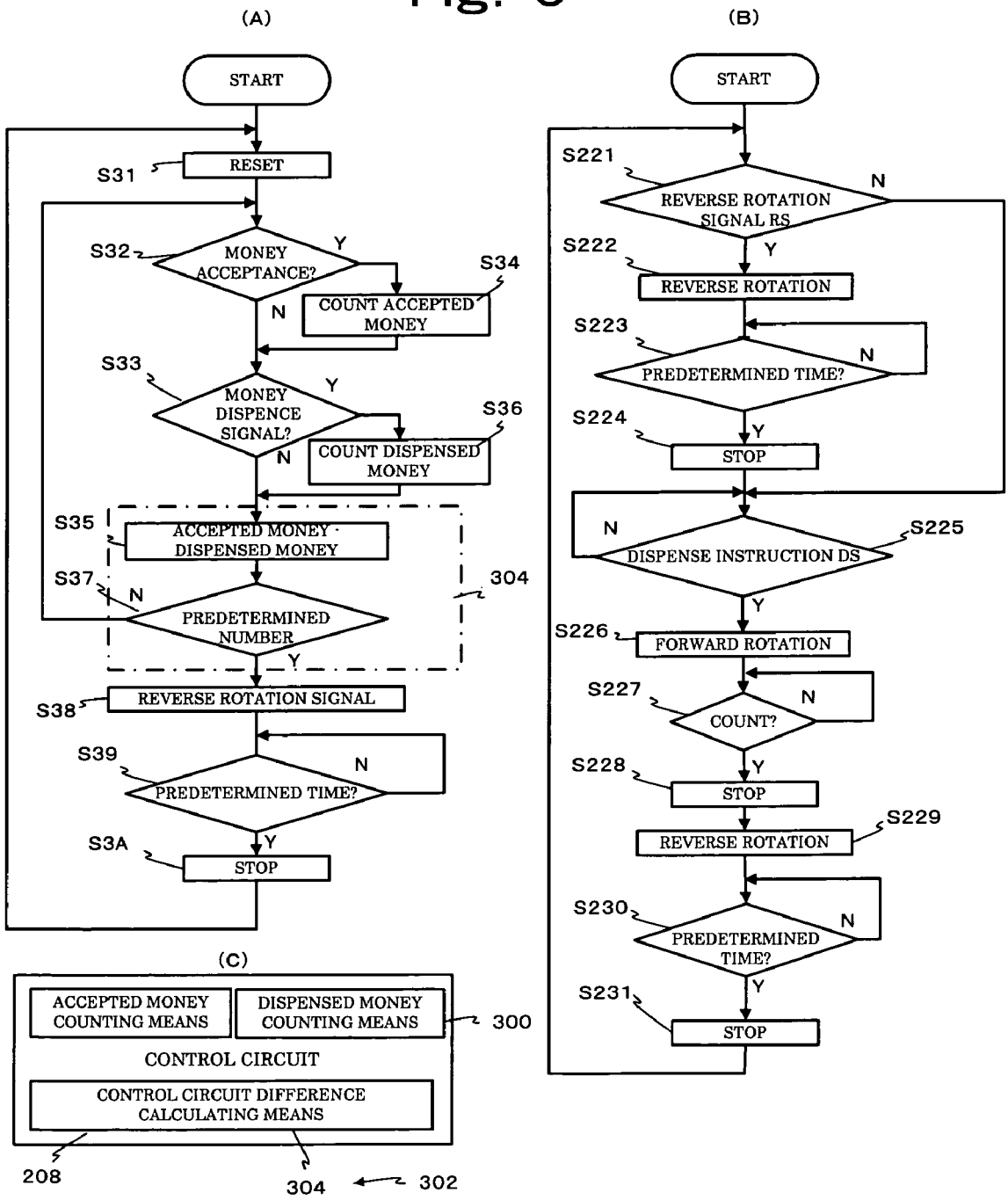
FIG. 6 is a block diagram and a flowchart for carrying out a coin dispensing method of the third embodiment of the present invention.

Next, the third embodiment will be explained with reference to FIG. 6. The third embodiment is different from the second embodiment in that the rotary disc 110 is reversely rotated when a difference between an accepted money count and a dispensed money count reaches a predetermined specified number, though the point that the rotary disc 110 is reversely rotated by a predetermined angle based on the accepted money count is taken over. As shown in FIG. 6(C), the control unit 124 includes an accepted money counting means 208, dispense counting means 300 and different calculating means 304 serving as a stacking amount detecting means 302. The accepted money counting means 208 has an identical function as the accepted money counting means 208 of the second embodiment.

The dispense counting means 300 counts a detection signal CU from the money dispense detector 122. The difference calculating means 304 calculates a difference between the counts of the accepted money counting means 208 and the dispense counting means 300, and when the accepted money count is larger than a predetermined amount, it outputs a reverse rotation signal CS to the reverse rotation unit 132. The stacking amount detecting means 302 is able to directly detect a stacking amount of the coins 102.

Next, an operation of the third embodiment will be explained. First, an explanation will be given for a difference calculating program shown in FIG. 6(A). At step S31, after conducting an initial setting by resetting the accepted money count and the dispense count stored in storage to zero, the program flow proceeds to step S32. At step S32, whether there is a money acceptance signal ES from the money acceptance detector 200 is determined. When there is no money acceptance signal ES, the flow proceeds to step S33, whereas when there is a money acceptance signal ES, the flow proceeds to step S34 where the count is incremented by one before proceeding to step S33.

At step S33, whether there is a dispense signal CU from the money dispense detector 122 is determined. When there is no dispense signal CU, the flow proceeds to step S35, whereas when there is a dispense signal CU, the flow proceeds to step S36 where the count is incremented by one before proceeding to step S35. Next, at step S35, a count value of the dispense number counted at step S36 is subtracted from the count value of accepted money number counted at step S34 to calculate a difference between the accepted money and dispensed money, and then the flow proceeds to step S37. At step S37, when the difference reaches a specified number, for example, 10, the flow proceeds to step S38, whereas when the difference does not reach the above number, the flow returns to step S32.

At step S38, after outputting a reverse rotation signal CS to the reverse rotation unit 132, the flow proceeds to step S39. After timing a predetermined period of time at step S39, the flow proceeds to step S3A where the reverse rotation signal CS is outputted to the reverse rotation unit 132. Accordingly, the motor 114 reversely rotates for a predetermined time period (predetermined angle) after preventing any excess dispension of coins by the sudden stop as described above, and then the coins 102 in the retaining bowl 108 are stirred and flattened as described above. Therefore, steps S35 and S37 correspond to the difference calculating means 304.

A money dispense processing program shown in FIG. 6(B) conducts processings in a similar manner as the second embodiment. To be more specific, at the time of dispensing coins, the rotary disc 110 forwardly rotates, and then reversely rotates by a predetermined angle upon completion of the instructed coin dispension, and the coins 102 are flattened by stirring on the reverse rotation. Therefore, in the case of the third embodiment, the rotary disc 110 is reversely rotated and the coins 102 are stirred not only after end of dispense of coins but also when the accepted money number exceeds the dispensed money number by a specified number.

In other words, when coins are almost continuously received and stacked, the rotary disc 110 is caused to reversely rotate to flatten the coins. In this way, since the third embodiment is able to flatten the coins 102 in the retaining bowl 108 to a comparable extent to that of the second embodiment despite less reverse rotation time of the motor 114, the energy consumption is reduced, and durability or the like of the motor 114 can be improved.

Next, a fourth embodiment of the present invention will be explained with reference to FIGS. 7 and 8. In the fourth embodiment, the second embodiment is applied to a coin recycling machine capable of automatically accepting and dispensing eight variations of euro coins. To be more specific, it is a coin recycling machine capable of retaining coins by denomination in the coin dispensing device after receiving a one-cent coin, two-cent coin, 10-cent coin, five-cent coin, 20-cent coin, one-euro coin, 50-cent coin, and two-euro coin in bulk, and automatically dispensing a specified number of a specified denomination based on an instruction for coin dispense.

Figure 7:
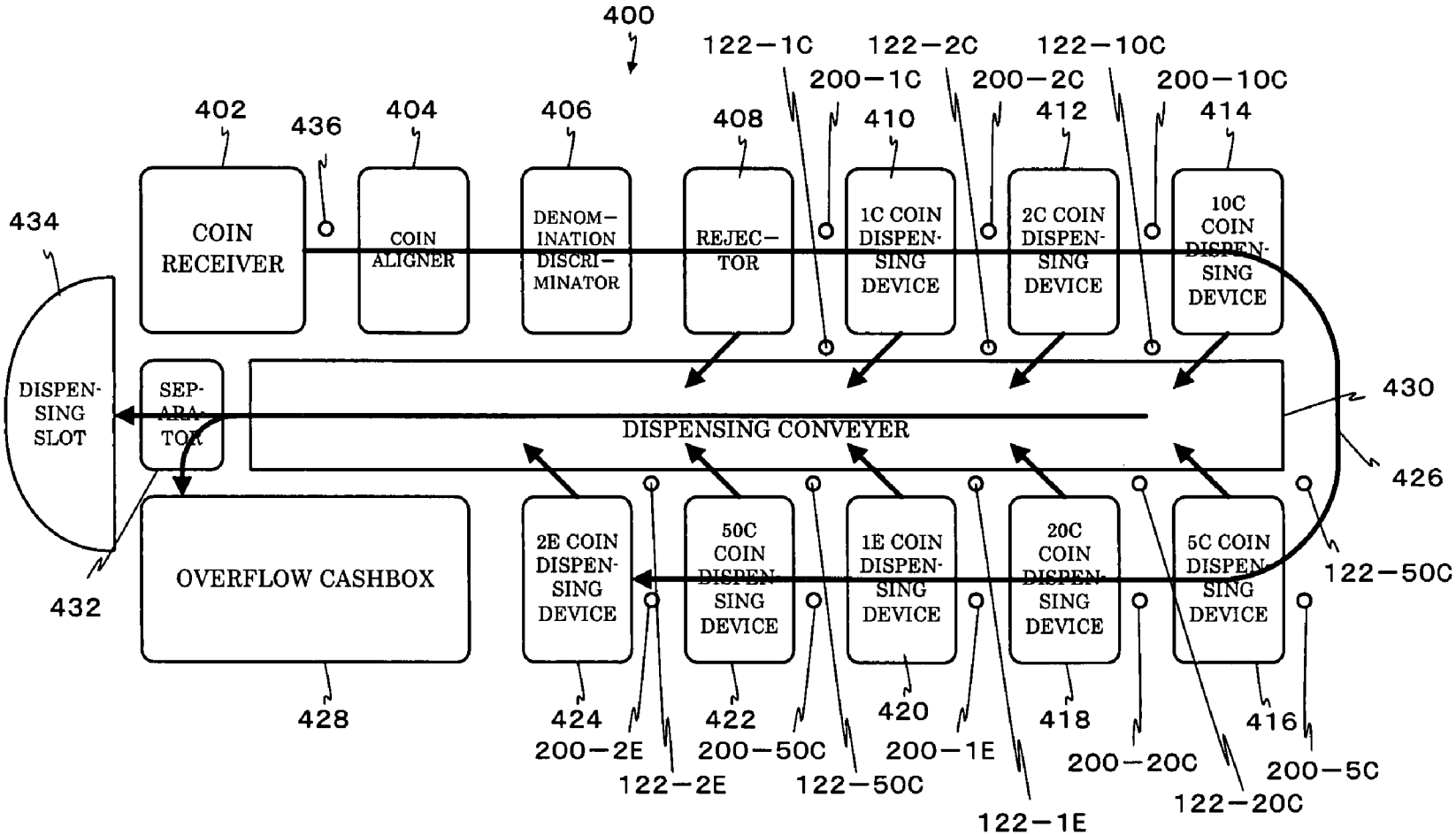
FIG. 7 is a schematic view of a coin recycling device for carrying out a coin dispensing method of a fourth embodiment of the present invention.
Figure 8:
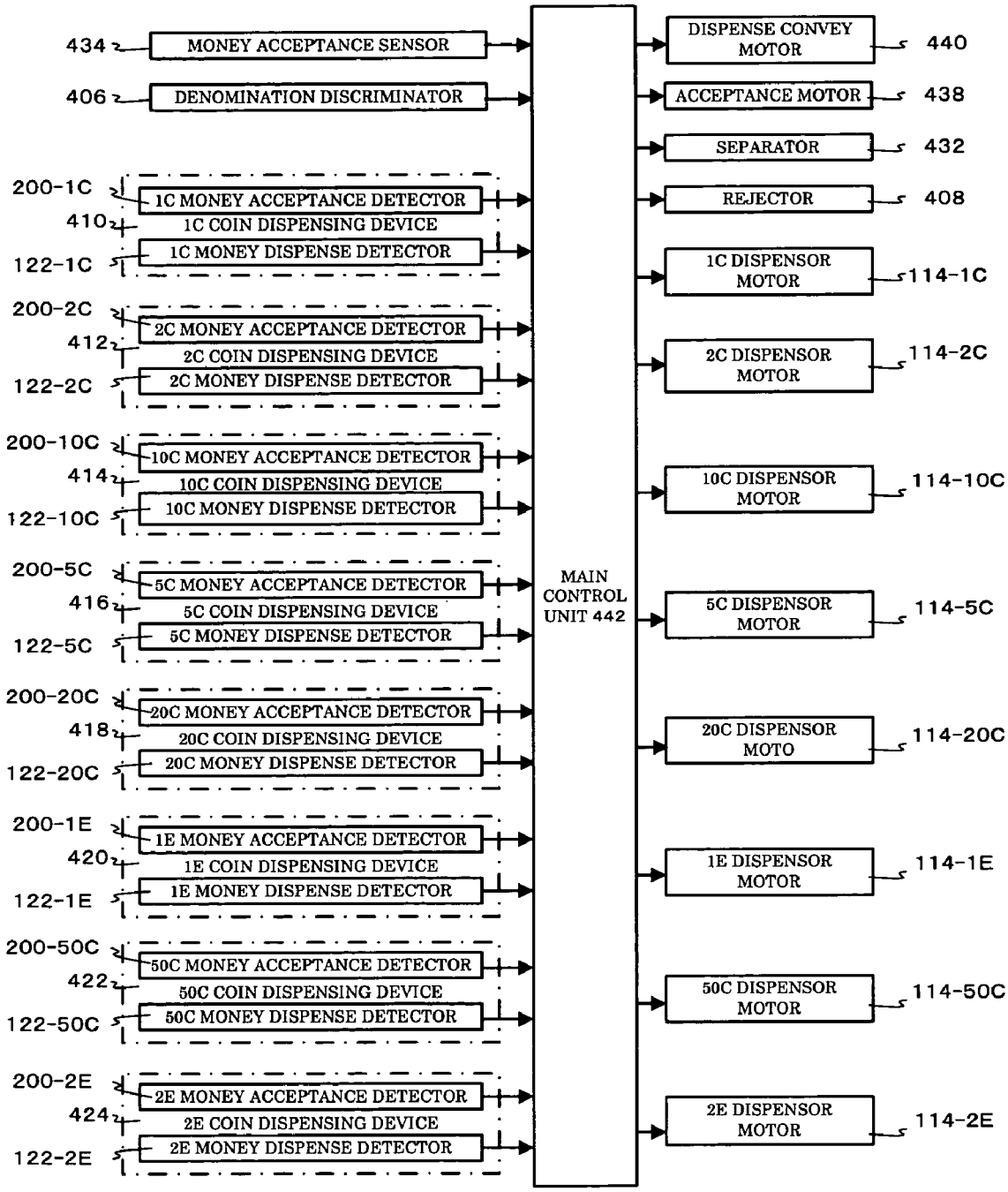
FIG. 8 is a block diagram of a coin recycling device for carrying out the coin dispensing method of a fourth embodiment of the present invention.

In FIG. 7, a coin recycling machine 400 includes a coin receiver 402, a coin aligner 404, a denomination discriminator 406, an unacceptable coin rejecter 408, a 1C-coin dispensing device 410, a 2C-coin dispensing device 412, a 10C-coin dispensing device 414, a 5C-coin dispensing device 416, a 20C-coin dispensing device 418, a 1-euro coin dispensing device 420, a 50-cent coin dispensing device 422 and a two euro coin dispensing device 424, a coin conveyer 426, an overflow cashbox 428, a dispensing conveyer 430, a separator 432 and a money dispensing slot 434.

The coin receiver 402 receives a plurality of coins in bulk, detects the acceptance by the money acceptance detector 436, activates an acceptance motor 438 to feed the coins into the coin aligner 404. The coins fed out of the coin receiver 402 are sequentially conveyed to the two-euro coin dispensing device 412 after passing a predetermined path from the coin aligner 404 by the coin converter 426.

The coin aligner 404 separates the plurality of coins received from the coin receiver 402 one by one, and aligns them to move in a line at predetermined intervals.

The denomination discriminator 406 discriminates real/fake or denomination of the coins fed from the coin aligner 404. The rejecter 408 returns the coins that are determined as fake or unacceptable in the denomination discriminator 406 to the dispensing slot 434 via the dispensing conveyer 430 and the separator 432. As the coin dispensing devices 410, 412, 414, 416, 418, 420, 422 and 424, the coin dispensing device 100 as shown in FIG. 2 can be employed, for example.

However, the size of the through-hole 148 of the rotary disc 110 is appropriately set to fit with the diameter of the retained coin, and the coin dropper 176 is adjusted within the range of the slot 178 in accordance with the position of the rotary disc 110 arranged to fit with the thickness of the coin 102. The dispensing conveyer 430 is, for example, a flat belt circulated by the motor 440, and arranged operatively to connect with the array of the respective coin dispensing devices. The dispensing conveyer 430 conveys coins 102 dispensed from each device toward the dispensing slot 434.

The separator 432 separates coins received from the dispensing conveyer 430 selectively into the dispensing slot 434 and the overflow cashbox 428. The dispensing slot 434 is a bowl container for allowing a customer or a casher to receive the dispensed plurality of coins. In inlets in the retaining bowl 108 of the coin dispensing devices, money acceptance detectors 200-1C, 200-2C, 200-10C, 200-5C, 200-20C, 200-1E, 200-SOC and 200-1E are respectively provided.

Each coin dispensing devices is provided with money dispense detectors 122-1C, 122-2C, 122-10C, 122-5C, 122-20C, 122-1E, 122-SOC and 122-2E, respectively. These detectors and the like are connected to the main control unit 442 of the coin recycling machine 400 and each motor is controlled by the main control unit 442.

The coin dispensing devices 410 to 424 of the fourth embodiment are operated according to the flow chart of the second embodiment. The coin recycling machine 400 for dispensing change can be placed adjacent to a POS register in a supermarket or the like and can be miniaturized, so that the retaining capacity of the retaining bowl 108 of the coin dispensing device 100 is limited.

Therefore, the disadvantage that can occur with newly accepted coins that will angularly stack can be prevented and effect on the retaining capacity of the retaining bowl 108 can be eliminated by stirring and flattening the coins by reverse rotation of the rotary disc.

Particularly, in the present invention, since the rotary disc 110 is reversely rotated, an additional device is not necessary, the machine size will not be enlarged and production with low cost is possible.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin recycling machine wherein coins are retained by separate denominations in separate coin dispensing devices and a specified number of a specified denomination of coins are dispensed according to a coin dispense instruction, the coin recycling machine separating coins inputted to a coin receiver by specified denominations in the course of conveyance on a predetermined path, and retaining the coins in bulk and dispensing coins one by one, automatically the coin recycling machine comprising:

a plurality of coin dispensing devices, each having a reverse rotation unit that automatically reversely rotates a rotary disc with through holes by a predetermined amount after separating and dispensing a specified number of coins one by one by a the rotary disc;

money acceptance detectors for detecting coins deposited into each coin dispensing device;

a money dispense detector for detecting coins dispensed from each coin dispensing devices, and for generating a coin dispensed signal for each dispensed coin detected; and a counting unit for counting a dispensed coin number based on the coin dispensed signals generated; and a controller unit for actuating a reverse rotation unit in a specific coin dispensing device for at least one rotation of the rotary disc when the dispensed coin number reaches a specified number, thereby retaining and stirring the retained coins in the specific coin dispensing device, wherein the controller unit determines an amount of reverse rotation of the rotary disc of at least 360° of rotation based on an amount of coins in each coin dispensing device and an accepted coin number for the money acceptance detectors, wherein at least one pin is mounted beneath the rotary disc to separate and dispense coins during the forward rotation of the rotary disc, the pin is configured with a partially sloping surface to retract the pin away from the rotary disc when a coin is rotated across the pin by contacting the sloping side and, wherein coins are not dispensed when the rotary disc is rotated in the opposite direction.

2. The coin recycling machine according to claim 1 wherein a retaining bowl surrounds the rotary disc and is fitted with a partial circular arc that substantially covers an edge of the rotary disc adjacent the through holes to prevent a coin from being oriented on a perimeter edge of the rotary disc and avoid dropping into a through hole.

3. The coin recycling machine according to claim 1 wherein the controller unit determines a reverse rotation of 720°.

4. A coin recycling machine wherein coins are retained by separate denominations in separate coin dispensing devices and a specified number of a specified denomination of coins are dispensed according to a coin dispense instruction, the coin recycling machine separating coins inputted to a coin receiver by specified denominations in the course of conveyance on a predetermined path, and retaining the coins in bulk and dispensing coins one by one, automatically the coin recycling machine comprising:

a plurality of coin dispensing devices, each having a reverse rotation unit that automatically reversely rotates a rotary disc with through holes by a predetermined amount after accepting a specified number of coins;

a money acceptance detector for detecting coins deposited into each coin dispensing device and for generating a coin accepted signal for each deposited coin detected; and a counting unit for counting an accepted coin number based on the coin accepted signals generated; and a controller unit for actuating a reverse rotation unit in a specific coin dispensing device for at least one rotation of the rotary disc when the accepted coins number reaches a specified number, thereby retaining and stirring the retained coins in the specific coin dispensing device, wherein the controller unit determines an amount of reverse rotation of the rotary disc of at least 360° of rotation based on an amount of coins in each coin dispensing device and an accepted coin number for the money acceptance detectors, wherein at least one pin is mounted beneath the rotary disc to separate and dispense coins during the forward rotation of the rotary disc, the pin is configured with a partially sloping surface to retract the pin away from the rotary disc when a coin is rotated across the pin by contacting the sloping side and, wherein coins are not dispensed when the rotary disc is rotated in the opposite direction.

5. The coin recycling machine according to claim 4 wherein a retaining bowl surrounds the rotary disc and is fitted with a partial circular arc that substantially covers an edge of the rotary disc adjacent the through holes to prevent a coin from being oriented on a perimeter edge of the rotary disc and avoid dropping into a through hole.

6. The coin recycling machine according to claim 4 wherein the controller unit determines a reverse rotation of 720°.

7. A coin recycling machine wherein coins are retained by separate denominations in separate coin dispensing devices and a specified number of a specified denomination of coins are dispensed according to a coin dispense instruction, the coin recycling machine separating coins inputted to a coin receiver by specified denominations in the course of conveyance on a predetermined path, and retaining the coins in bulk and dispensing coins one by one, automatically, the coin recycling machine comprising:

a plurality of coin dispensing devices, each having a reverse rotation unit that automatically reversely rotates a rotary disc with through holes by a predetermined amount after accepting, separating and dispensing a specified number of coins one by one by the rotary disc;

a money acceptance detector for detecting coins deposited into each coin dispensing device and for generating a coin accepted signal for each deposited coin detected;

a first counting unit for counting an accepted coins number based on the coin accepted signals generated;

a money dispense detector for detecting coins dispensed from each coin dispensing device, and for generating a coin dispensed signal for each dispensed coin detected;

a second counting unit for counting a dispensed coins number based on the coin dispensed signals generated;

a stacking amount detector for calculating a coin retaining amount based on the difference between the accepted coins number and the dispensed coins number; and a controller unit for actuating a reverse rotation unit in a specific coin dispensing device for at least one rotation of the rotary disc when the coin retaining amount reaches a specified number, thereby retaining and stirring the retained coins in the specific coin dispensing device, wherein the controller unit determines an amount of reverse rotation of the rotary disc of at least 360° of rotation based on an amount of coins in each coin dispensing device and an accepted coin number for the money acceptance detectors, wherein at least one pin is mounted beneath the rotary disc to separate and dispense coins during the forward rotation of the rotary disc, the pin is configured with a partially sloping surface to retract the pin away from the rotary disc when a coin is rotated across the pin by contacting the sloping side and, wherein coins are not dispensed when the rotary disc is rotated in the opposite direction.

8. The coin recycling machine according to claim 7 wherein a retaining bowl surrounds the rotary disc and is fitted with a partial circular arc that substantially covers an edge of the rotary disc adjacent the through holes to prevent a coin from being oriented on a perimeter edge of the rotary disc and avoid dropping into a through hole.

9. The coin recycling machine according to claim 7 wherein the controller unit determines a reverse rotation of 720°.

* * * * *